US009614305B2

(12) United States Patent
Uchida

(10) Patent No.: US 9,614,305 B2
(45) Date of Patent: Apr. 4, 2017

(54) CONNECTOR

(71) Applicant: Sumitomo Wiring Systems, Ltd., Yokkaichi, Mie (JP)

(72) Inventor: Masashi Uchida, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/063,551

(22) Filed: Mar. 8, 2016

(65) Prior Publication Data

US 2016/0294077 A1 Oct. 6, 2016

(30) Foreign Application Priority Data

Apr. 3, 2015 (JP) ..... 2015-076895

(51) Int. Cl.
*H01R 11/28* (2006.01)
*H01R 13/426* (2006.01)
*H01R 4/18* (2006.01)

(52) U.S. Cl.
CPC ..... *H01R 11/28* (2013.01); *H01R 4/184* (2013.01); *H01R 13/426* (2013.01)

(58) Field of Classification Search
CPC ..... H01R 11/28; H01R 4/184; H01R 13/426
See application file for complete search history.

(56) References Cited

U.S. PATENT DOCUMENTS 6,666,732 B1 * 12/2003 Endacott ..... H01R 4/187 439/730
7,901,246 B2 * 3/2011 Takayama ..... H01R 4/20 439/585
8,992,244 B2 * 3/2015 Uchiyama ..... H01R 13/52 439/271
9,331,399 B2 * 5/2016 Itou ..... H01R 43/005
9,356,388 B2 * 5/2016 Aizawa ..... H01R 4/72
2013/0133946 A1 * 5/2013 Morikawa ..... H01R 4/185 174/77 R
2016/0268794 A1 * 9/2016 Wakabayashi ..... H02G 3/04
2016/0294096 A1 * 10/2016 Uchida ..... H01R 13/426
2016/0294097 A1 * 10/2016 Uchida ..... H01R 13/5205

FOREIGN PATENT DOCUMENTS

JP 2014-75298 4/2014

* cited by examiner

*Primary Examiner* — Ross Gushi
(74) *Attorney, Agent, or Firm* — Gerald E. Hespos; Michael J. Porco; Matthew T. Hespos

(57) ABSTRACT

A connector including a terminal fitting having a wire connecting portion crimped to an end of a wire and configured to be inserted into a terminal accommodating chamber of a housing. A sleeve is mounted on a rear part of the terminal fitting and retains the terminal fitting by engaged the terminal fitting and a wall surface of the terminal accommodating chamber. A heat shrinkable tube is fitted on an outer periphery of the wire connecting portion while being accommodated in the sleeve and held in close contact with an outer periphery of the terminal fitting by being thermally shrunk. The sleeve includes a lift-up portion for holding the heat shrinkable tube in a fitted state so that a clearance is secured between the heat shrinkable tube and an upper surface of the wire connecting portion by lifting up the heat shrinkable tube before thermal shrinkage in a radial direction.

5 Claims, 16 Drawing Sheets

CONNECTOR

BACKGROUND

1. Field of the Invention

This invention relates to a connector.

2. Description of the Related Art

Japanese Unexamined Patent Publication No. 2014-75298 discloses a charging connector with a means for retaining and accommodating a terminal fitting at a predetermined position in a housing. The terminal fitting has a wire connecting portion crimped to an end of a wire and a spacer formed of a sleeve made of resin and mounted around the wire connecting portion. The charging connector is structured such that the terminal fitting is inserted into a terminal accommodating chamber of the housing together with the spacer and the terminal fitting is locked to the front end of the spacer and the rear end of the spacer is locked to a rear end part of the terminal accommodating chamber. The terminal fitting is retained and accommodated at a predetermined position of the terminal accommodating chamber of the housing.

In the charging connector as described above, the end of the wire needs to be sealed by, for example, a heat shrinkable tube. Specifically, the heat shrinkable tube is fitted on the outer periphery of the wire connecting portion after the wire connecting portion is crimped to the end of the wire, the heat shrinkable tube is set in a heating apparatus and heated to be thermally shrunk, and adhesive applied to the inner peripheral surface in advance is melted and bonded to the outer peripheral surface of the wire connecting portion, whereby the end of the wire is sealed. The spacer is mounted thereafter.

The heat shrinkable tube is so formed that an upper part of the inner peripheral surface comes into contact with the upper surface of the wire connecting portion and hangs down by its own weight. If the heat shrinkable tube is heated in this state, the adhesive, particularly the adhesive on the upper part of the inner peripheral surface flows down to a lower side while the adhesive is melted and the heat shrinkable tube is gradually contracted in diameter. When the heat shrinkable tube is contracted in diameter until the inner peripheral surface of the heat shrinkable tube comes into close contact with the outer peripheral surface of the wire connecting portion, the amount of the adhesive may become insufficient on the upper side of the inner peripheral surface and a sealing function may be impaired.

The technology disclosed by this specification was completed based on the above situation and aims to enable an end of a wire to be reliably sealed over the entire circumference.

SUMMARY

The technology disclosed by this specification is directed to a connector with a terminal fitting including a wire connecting portion to be crimped to an end of a wire and configured to be inserted into a terminal accommodating chamber formed in a housing from behind. A sleeve is mounted on a rear part of the terminal fitting and functions to retain the terminal fitting by being engaged with each of the terminal fittings and a wall surface of the terminal accommodating chamber. A heat shrinkable tube is fitted on an outer periphery of the wire connecting portion of the terminal fitting while being accommodated in the sleeve and held in close contact with the outer periphery by being thermally shrunk. The sleeve includes a lift-up portion for holding the heat shrinkable tube in such a fitted state that a clearance is secured between the heat shrinkable tube and an upper surface of the wire connecting portion by lifting up the heat shrinkable tube before thermal shrinkage in a radial direction against the own weight of the heat shrinkable tube.

The heat shrinkable tube fitted on the wire connecting portion of the terminal fitting is heated while being accommodated in the sleeve. At this time, the heat shrinkable tube is lifted up by the lift-up portion provided in the sleeve and held in such a fitted state that the clearance is secured between the heat shrinkable tube and the upper surface of the wire connecting portion. When being heated in such a state, the heat shrinkable tube is gradually contracted in diameter while adhesive applied to an inner peripheral surface is melted. However, since an upper part of the inner peripheral surface of the heat shrinkable tube is not placed on the wire connecting portion to secure the clearance and a space on a lower side of the inner peripheral surface of the heat shrinkable tube is eliminated, the flow-down of the adhesive on the upper side of the inner peripheral surface is suppressed and a certain amount of the adhesive is ensured. Thus, when the heat shrinkable tube is contracted in diameter until coming into close contact with the outer peripheral surface of the wire connecting portion, the heat shrinkable tube is bonded with the amount of the adhesive ensured over the entire circumference, with the result that sealing is reliably provided around the wire connecting portion, i.e. the end of the wire over the entire circumference.

Further, since the heat shrinkable tube is positioned in the radial direction utilizing the sleeve, which is a component necessary to retain and accommodate the terminal fitting, the simplification of a sealing step and the like is realized, which can contribute to a cost reduction.

The following configurations may be adopted.

The sleeve includes a positioning portion configured to regulate a backward movement of the heat shrinkable tube by being engaged with a rear end of the heat shrinkable tube before thermal shrinkage.

The heat shrinkable tube before thermal shrinkage can be positioned in the axial direction. Thus, the heat shrinkable tube can be reliably held in contact with the wire connecting portion over the entire length and sealability is ensured.

An insertion groove for enabling the wire connecting portion to be radially inserted and accommodated therethrough is formed on an outer peripheral surface of the sleeve and the lift-up portion is configured by ribs formed along a groove edge of the insertion groove.

The sleeve is mounted on the rear part of the terminal fitting while the wire connecting portion and the heat shrinkable tube are radially inserted through the insertion groove. At that time, the heat shrinkable tube is lifted by the ribs and held in such a fitted state that the clearance is secured between the heat shrinkable tube and the upper surface of the wire connecting portion. The heat shrinkable tube is positioned in the radial direction while easy mounting of the sleeve is ensured.

An insertion groove enabling the wire connecting portion to be radially inserted and accommodated therethrough is formed on an outer peripheral surface of the sleeve and the positioning portion is configured by forming a tapered portion gradually narrowed toward back on a wall surface of a rear end part of an accommodation space of the sleeve.

The sleeve is mounted on the rear part of the terminal fitting while the wire connecting portion and the heat shrinkable tube are radially inserted through the insertion groove. At that time, the rear end of the heat shrinkable tube is engaged with the tapered portion, whereby the heat shrinkable tube is pushed forward up to a proper position. The heat shrinkable tube is positioned in an axial direction while easy mounting of the sleeve is ensured.

A lock portion configured to hold the terminal fitting and the sleeve in a coupled state is provided between the terminal fitting and the sleeve.

Since the terminal fitting and the sleeve can be integrally temporarily assembled, a heating operation of the heat shrinkable tube and the like can be efficiently performed.

According to the technology disclosed by this specification, it is possible to reliably seal an end of a wire over the entire circumference.

DETAILED DESCRIPTION

Figure 18:
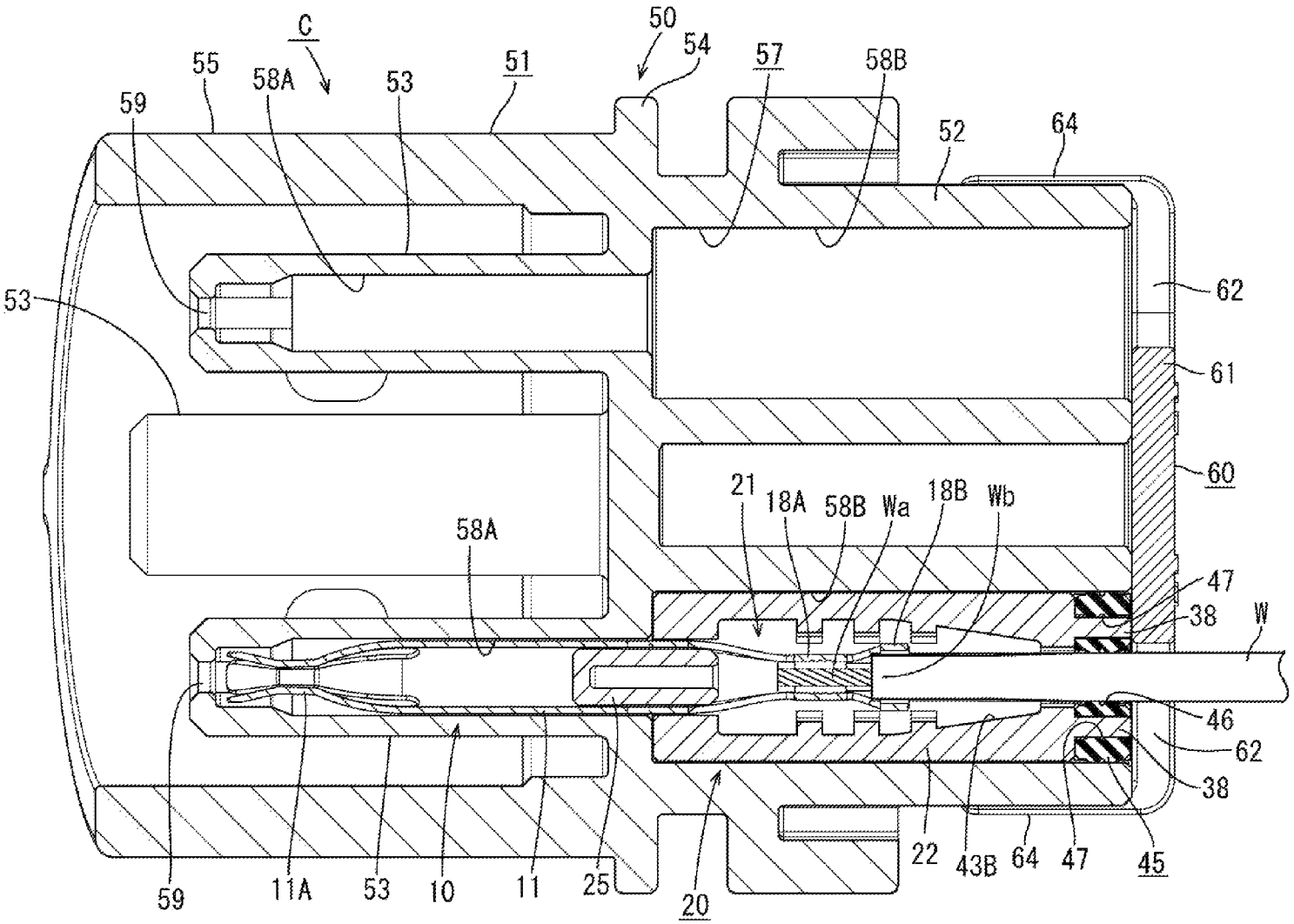
FIG. 18 is a section along XVIII-XVIII of FIG. 17.

A charging connector C is illustrated and connected to a vehicle-side connector provided in a vehicle by being mounted on the tip of a gun-shaped case (not shown). The charging connector C of this embodiment (hereinafter, merely referred to as the connector C) is a five-pole connector and includes terminal fittings 10 connected to ends of wires W and a housing 50 for accommodating the terminal fittings 10 as shown in FIG. 18. The terminal fittings 10 are composed of two power terminals, one ground terminal and two signal terminals and basic structures thereof are similar although diameters and the like may be different depending on the type. The following description is given, taking the signal terminal as an example.

Figure 1:
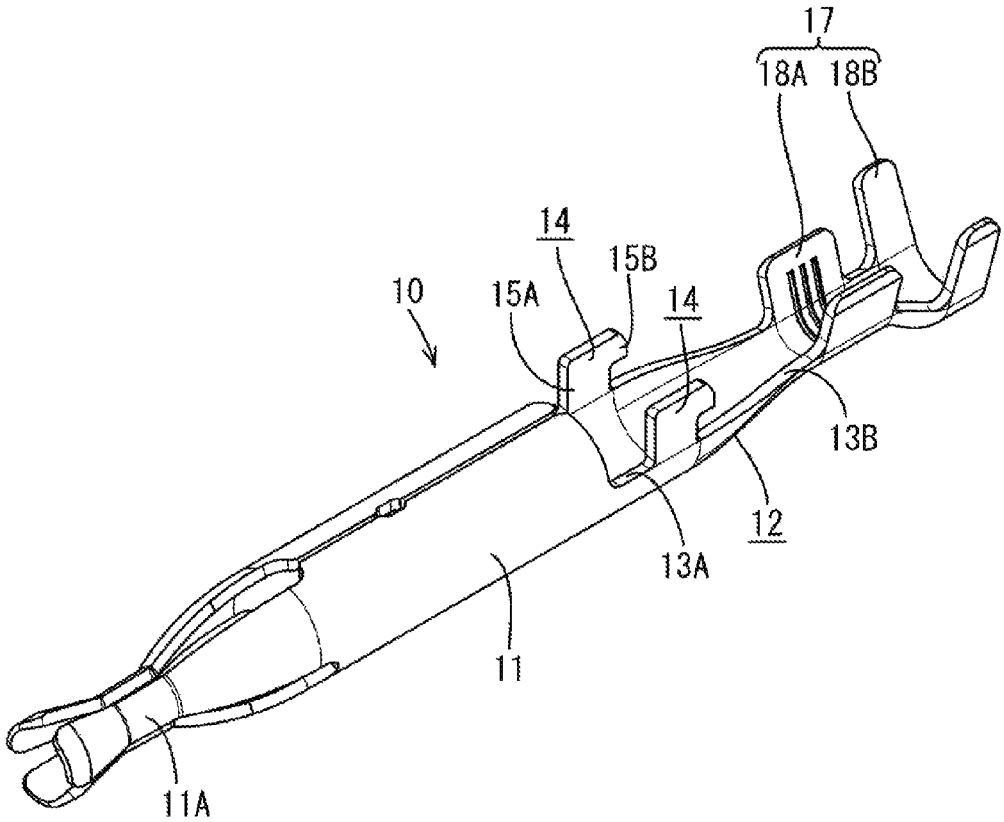
FIG. 1 is a perspective view of a terminal fitting according to an embodiment.
Figure 2:
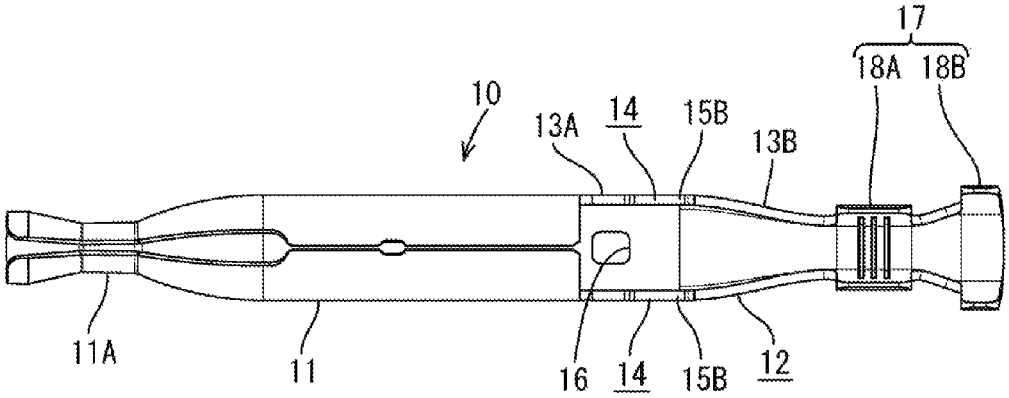
FIG. 2 is a plan view of the terminal fitting.
Figure 3:
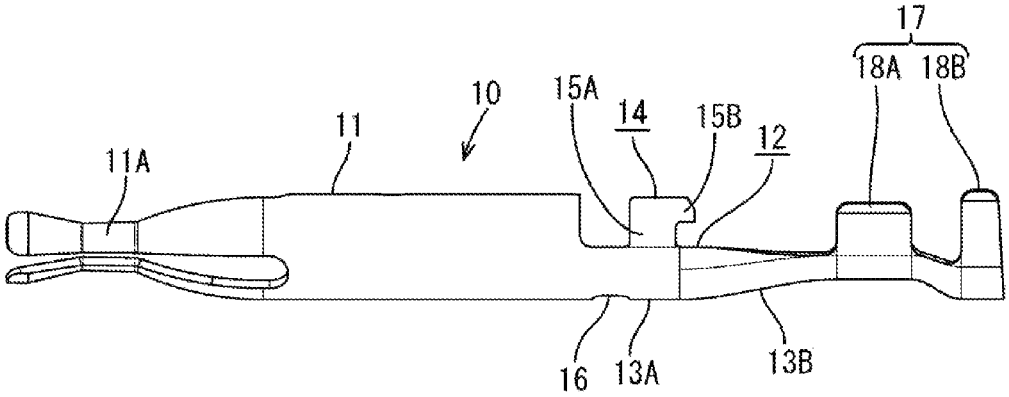
FIG. 3 is a side view of the terminal fitting.

The terminal fitting 10 is a female terminal and formed into a shape as shown in FIGS. 1 to 3 by press-forming a metal plate with excellent electrical conductivity. The terminal fitting 10 is so formed that a terminal connecting portion 11 to be connected to a mating vehicle-side terminal (male terminal), a coupling portion 12 and a wire connecting portion 17 to be crimped to the end of the wire W are successively connected from front. The terminal connecting portion 11 is bent and curved into a hollow cylindrical shape, a tip part thereof is constricted and formed with a plurality of (three in the shown example) slots, thereby forming a contact portion 11A which is resiliently expandable and contractible in diameter. The wire connecting portion 17 is formed such that an open wire barrel 18A and an open insulation barrel 18B are provided side by side in a front-back direction. The coupling portion 12 couples the terminal connecting portion 11 and the wire connecting portion 17 and is formed to have a U-shaped cross-section open on the upper surface. A substantially half length area on a front side of the coupling portion 12 is an equal-width portion 13A having the same width as a diameter of the terminal connecting portion 11 and a remaining rear area is a tapered portion 13B whose width is gradually narrowed toward the back.

A pair of inclination regulating pieces 14 are formed parallel to each other on the upper edges of opposite left and right walls of the equal-width portion 13A. The inclination regulating piece 14 is formed into such a hook shape that a sandwiched portion 15B projecting backward is provided on the upper end of a standing portion 15A.

Figure 15:
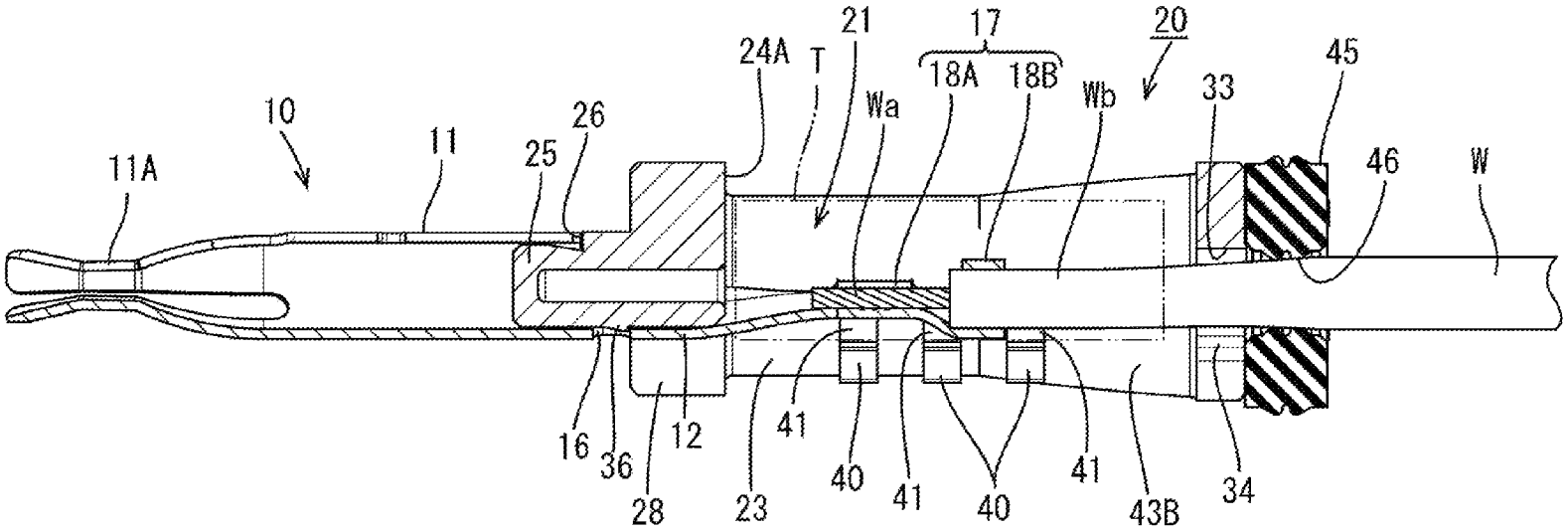
FIG. 15 is a section along XV-XV of FIG. 11.

The end of the wire W is connected to the wire connecting portion 17 of the terminal fitting 10 structured as described above. Specifically, as shown in FIG. 15, stripping is applied at the end of the wire W to remove an insulation coating Wb a predetermined distance and an end of a core Wa projects in an exposed manner from the remaining end of the insulation coating Wb. The end of the core Wa is connected to the wire barrel 18A of the terminal fitting 10 by crimping and the end of the insulation coating Wb is connected to the insulation barrel 18B by crimping. Particularly, unevenness is formed in both radial and axial directions on the upper surface side of the wire connecting portion 17 after crimping. A part of the end of this wire W connected to the wire connecting portion 17 by crimping is sealed, utilizing a heat shrinkable tube T, as described in detail later.

Figure 17:
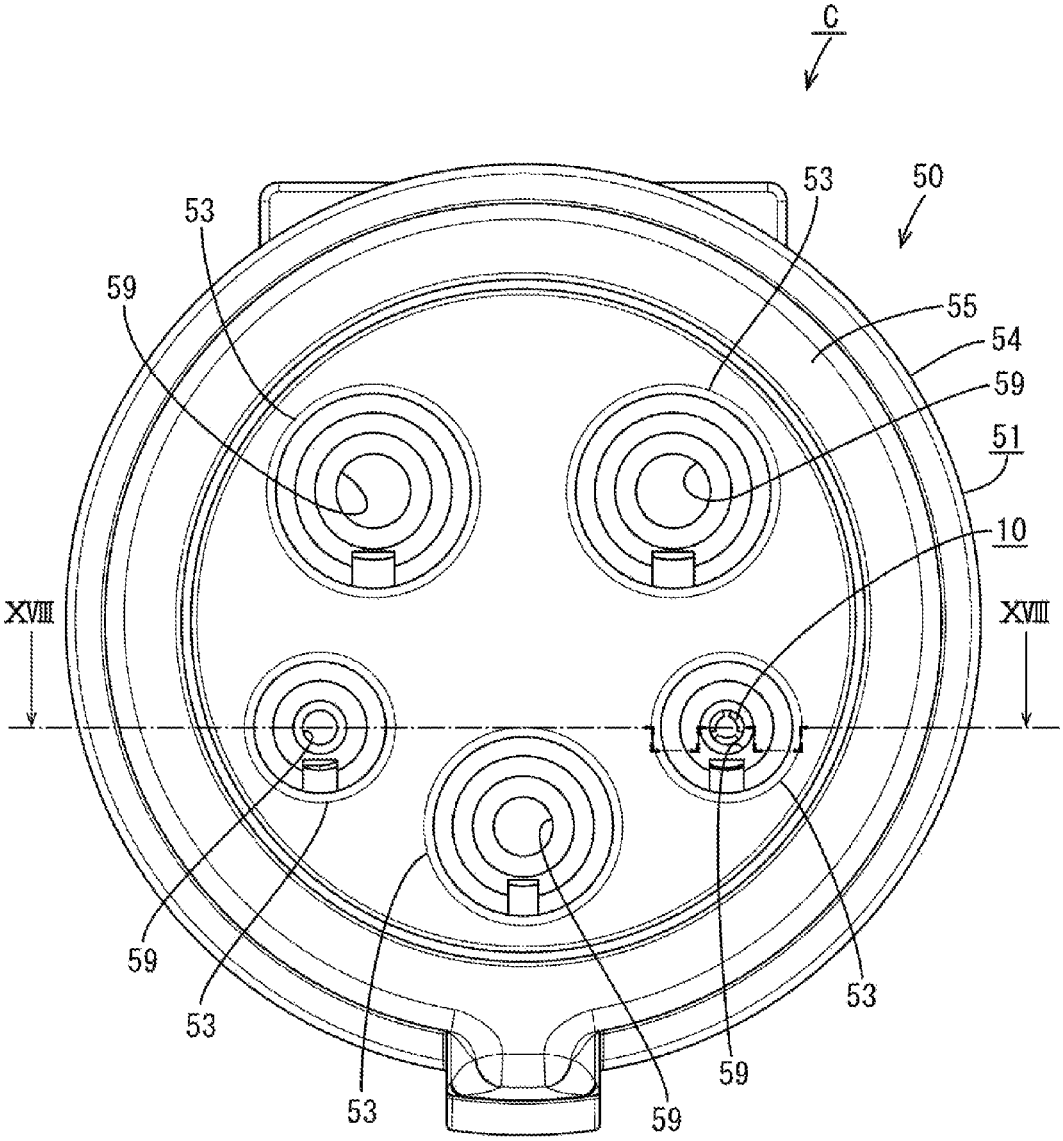
FIG. 17 is a front view of a connector.

The housing 50 is made of synthetic resin and includes, as shown in FIGS. 17 and 18, a housing main body 51 provided on the front surface of a short base portion 52 having a cylindrical shape. Five tubular portions 53 in a predetermined arrangement project from the housing main body.

A flange 54 is formed on the outer periphery of the front end of the base portion 52 of the housing main body 51. A tubular receptacle 55 having an open front surface is formed at a predetermined distance from the outer periphery of a group of the tubular portions 53. An opening edge of the receptacle 55 projects more forward than the front ends of the tubular portions 53 by a predetermined distance as shown in FIG. 18.

The receptacle 55 of the housing 50 is tightly inserted into an insertion port open on a panel of the vehicle, although not shown, the insertion is stopped by the contact of the flange 54 with an opening edge of the insertion port on a front surface side and, associated with that, the receptacle 55 and front sides (tubular portions 53) of the housing main body 51 are connected to the mating vehicle-side connector arranged on the back side of the insertion port. On the other hand, the base portion 52 of the housing main body 51 is fitted and mounted on the tip of the gun-shaped case.

Five terminal accommodating chambers 57 are formed in the housing main body 51. The five terminal accommodating chambers 57 extend through the base portion 52 in the front-back direction to individually reach the respective tubular portions 53 from the rear surface of the base portion 52. Out of the five terminal accommodating chambers 57, two in an upper stage of FIG. 17 are for the power terminals, the slightly lower one in a center out of the three terminal accommodating chambers 57 in a lower stage is for the ground terminal, and two left and right ones are for the signal terminals.

Basic structures of the respective terminal accommodating chambers 57 are similar although diameters and the like may be different in accordance with the types of the terminal fittings 10 to be accommodated. The following description is given, taking the terminal accommodating chamber 57 for the signal terminal as an example.

As shown in FIG. 18, the terminal accommodating chamber 57 is formed into such a step shape that a front half located in the tubular portion 53 has a small diameter and a rear half penetrating through the inside of the base portion 52 has a large diameter. More specifically, the front half having the small diameter serves as a front accommodating portion 58A in which the terminal connecting portion 11 of the terminal fitting 10 is to be accommodated, and the inner peripheral surface of the front end thereof is contracted in diameter to form a terminal insertion opening 59 into which the mating vehicle-side terminal is to be inserted. The rear half having the large diameter serves as a rear accommodating portion 58B into which a sleeve 20 arranged around the crimped wire connecting portion 17 of the terminal fitting 10 on a rear part of the terminal fitting 10 is to be accommodated.

The sleeve 20 is made of synthetic resin and functions to prevent the terminal fitting 10 from coming out backward from the terminal accommodating chamber 57. As shown in FIGS. 4 to 7, the sleeve 20 is formed into a substantially hollow cylindrical shape substantially tightly fittable to the rear accommodating portion 58B and internally provided with an accommodation space 21 capable of accommodating the wire connecting portion 17 and parts before and after the wire connecting portion 17. More specifically, the sleeve 20 includes a sleeve main body 22 slightly shorter than the rear accommodating portion 58B and having a cylindrical outer shape, this sleeve main body 22 is formed with a through hole 23 penetrating through upper and lower surfaces, and the inside of this through hole 23 serves as the accommodation space 21.

Figure 6:
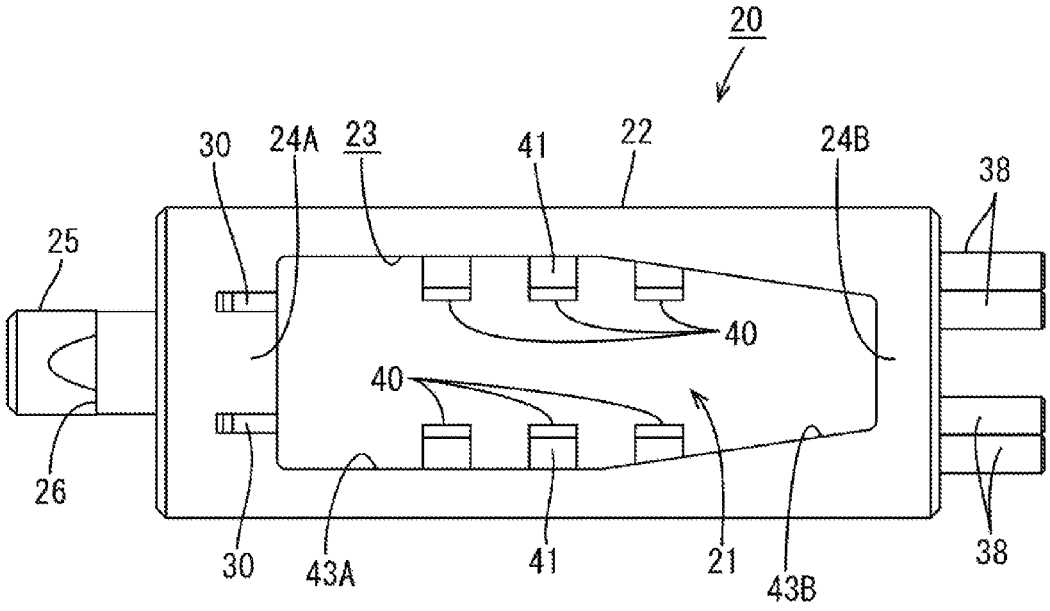
FIG. 6 is a plan view of the sleeve.

As shown in FIG. 6, the through hole 23 has a length, which is about ¾ of the entire length of the sleeve main body 22, and a width, which is slightly more than 80% of a diameter of the sleeve main body 22, and is formed at a position of the sleeve main body 22 slightly displaced to the rear end. Thus, a front wall 24A of the accommodation space 21 is relatively thick and a rear wall 24B is relatively thin. A fitting protrusion 25 in the form of a round bar substantially tightly fittable into a base end side of the terminal connecting portion 11 of the above terminal fitting 10 is formed to project forward in a center of the front surface of the front wall 24A, and an arcuate stopper portion 26 capable of abutting against the upper edge of the rear end surface of the terminal connecting portion 11 is formed on the upper surface of a base end side of this fitting protrusion 25.

Figure 7:
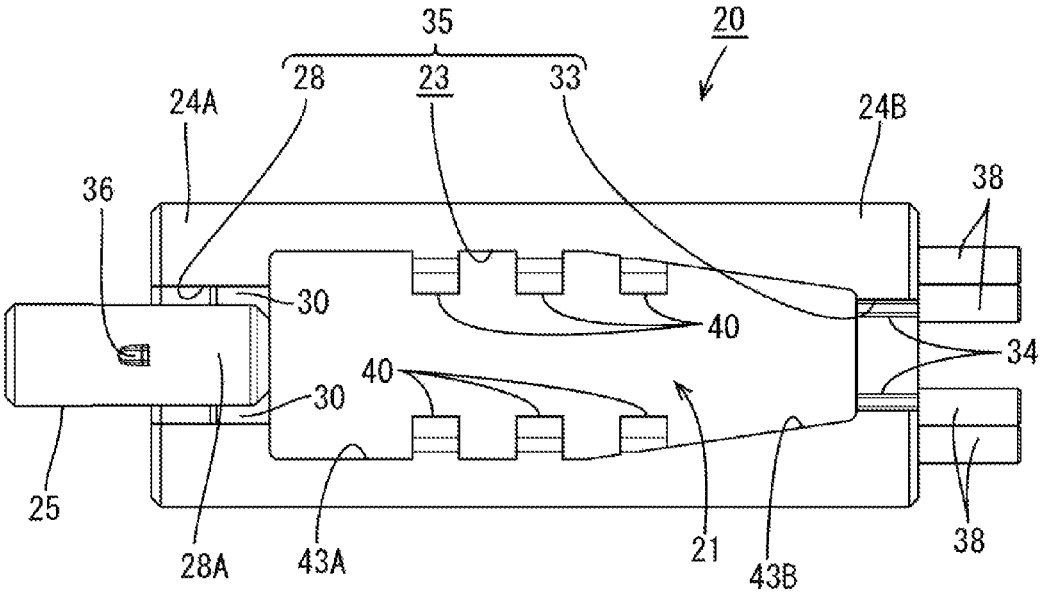
FIG. 7 is a bottom view of the sleeve.

As shown in FIG. 7, a front insertion groove 28 through which the equal-width portion 13A in the coupling portion 12 of the terminal fitting 10 is insertable from below is formed on the lower surface of the front wall 24A of the sleeve main body 22. The front surface of this front insertion groove 28 is open and the rear surface communicates with the front surface of the through hole 23. An arcuate portion 28A with which the groove bottom of the equal-width portion 13A of the coupling portion 12 comes into contact is so formed on the ceiling surface of the front insertion groove 28 as to be flush with the lower surface of the fitting protrusion 25 described above.

Figure 16:
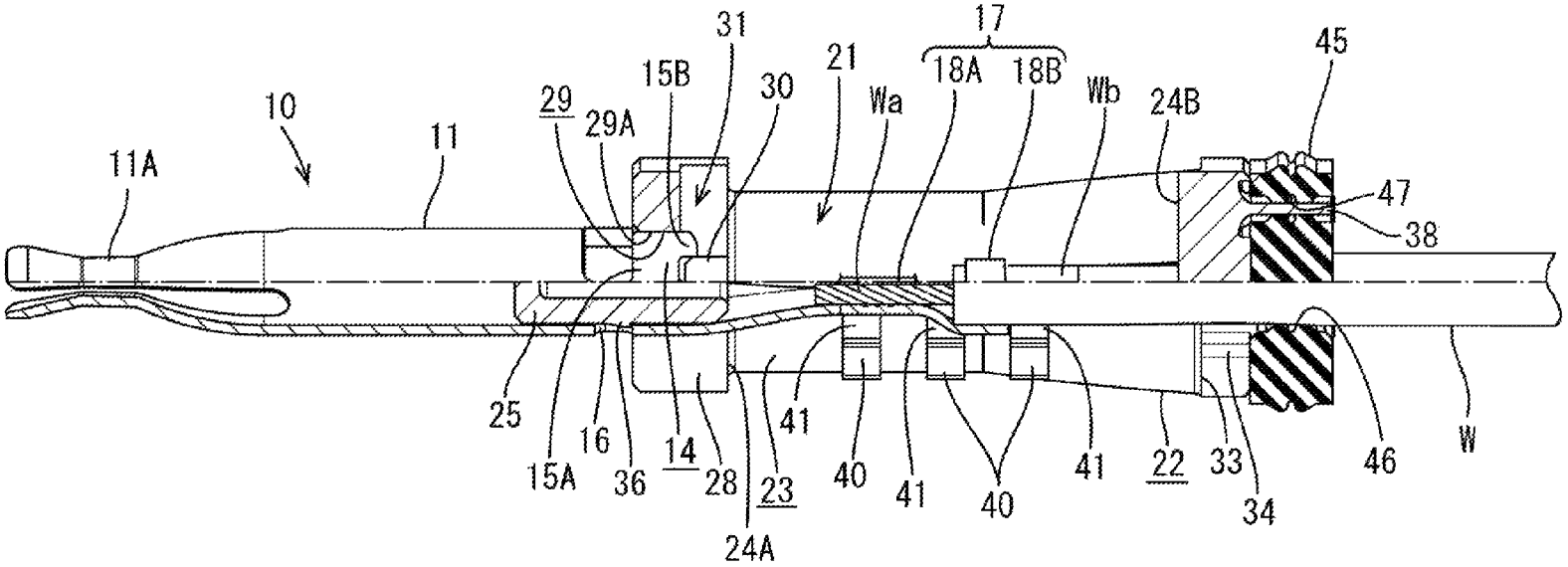
FIG. 16 is a section along XVI-XVI of FIG. 11.

A pair of slits 29 into which the inclination regulating pieces 14 are tightly insertable are formed to stand on opposite left and right side surfaces of the front insertion groove 28. As shown in FIG. 16, a ceiling surface 29A of each slit 29 is set at such a position that the upper surface of the sandwiched portion 15B of the inclination regulating piece 14 comes into contact with the ceiling surface 29A when the equal-width portion 13A of the coupling portion 12 of the terminal fitting 10 is inserted into the front insertion groove 28 from below and reaches a proper position (position where the groove bottom of the equal-width portion 13A is in contact with the arcuate portion 28A).

Figure 5:
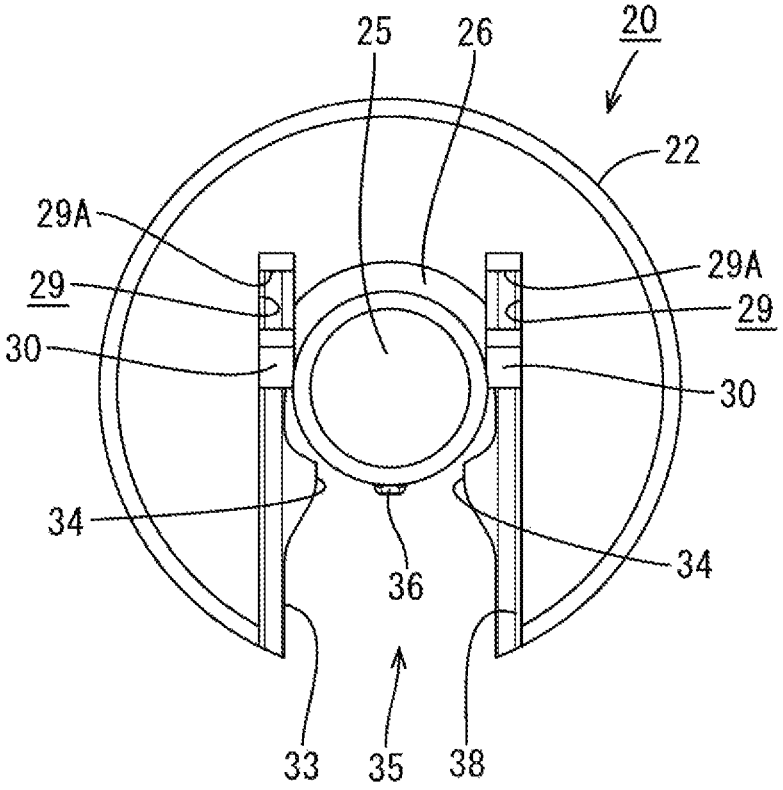
FIG. 5 is a front view of the sleeve.

Further, as shown in FIGS. 5 and 16, sandwiching protrusions 30 which can come to lower surface sides of projecting end parts of the sandwiched portions 15B when the equal-width portion 13A is inserted to the proper position into the front insertion groove 28 are formed to protrude at positions of the left and right side surfaces of the front insertion groove 28 along a rear edge part. Specifically, as described later, the sandwiched portions 15B of the inclination regulating pieces 14 are sandwiched by the ceiling surfaces 29A of the slits 29 and the sandwiching protrusions 30, thereby regulating inclination of the terminal fitting 10 so that axial lines of the terminal fitting 10 and the sleeve 20 are inclined relative to each other, i.e. thereby configuring an inclination regulating portion 31.

As shown in FIG. 7, a rear insertion groove 33 through which the wire W pulled out from the terminal fitting 10 is radially insertable from below is formed on the lower surface of the rear wall 24B of the sleeve main body 22. The rear surface of this rear insertion groove 33 is open and the front surface communicates with the rear surface of the through hole 23. As shown in FIG. 5, locking protrusions 34 for locking the wire W radially inserted through the rear insertion groove 33 and holding this wire W on the same axial line as the terminal fitting 10 are formed to face each other on left and right side surfaces of the rear insertion groove 33.

As described above, the front and rear insertion grooves 28, 33 are formed before and after the through hole 23 to communicate, whereby an insertion groove 35 through which the coupling portion 12 and the wire connecting portion 17 of the terminal fitting 10 and the wire W pulled out from the wire connecting portion 17 are radially insertable is formed over the entire length on the lower surface of the sleeve main body 22 as shown in FIG. 7.

Although described in detail later, the sleeve 20 is arranged on the rear part of and concentrically with the terminal fitting 10 such that the fitting protrusion 25 projecting on the front surface of the sleeve main body 22 is fitted into the rear end of the terminal connecting portion 11 of the terminal fitting 10. As a means for coupling and locking the sleeve 20 on the rear part of the terminal fitting 10, a lock protrusion 36 is formed on the lower surface of the base end side of the fitting protrusion 25 of the sleeve 20 as shown in FIG. 7, whereas a lock hole 16 is open at a position of the bottom surface of the equal-width portion 13A of the coupling portion 12 near the front end as shown in FIG. 2. By fitting the lock protrusion 36 into the lock hole 16 when the fitting protrusion 25 is fitted into the rear end of the terminal connecting portion 11 by a regular amount, the terminal fitting 10 and sleeve 20 are locked in an integrally coupled state.

Figure 4:
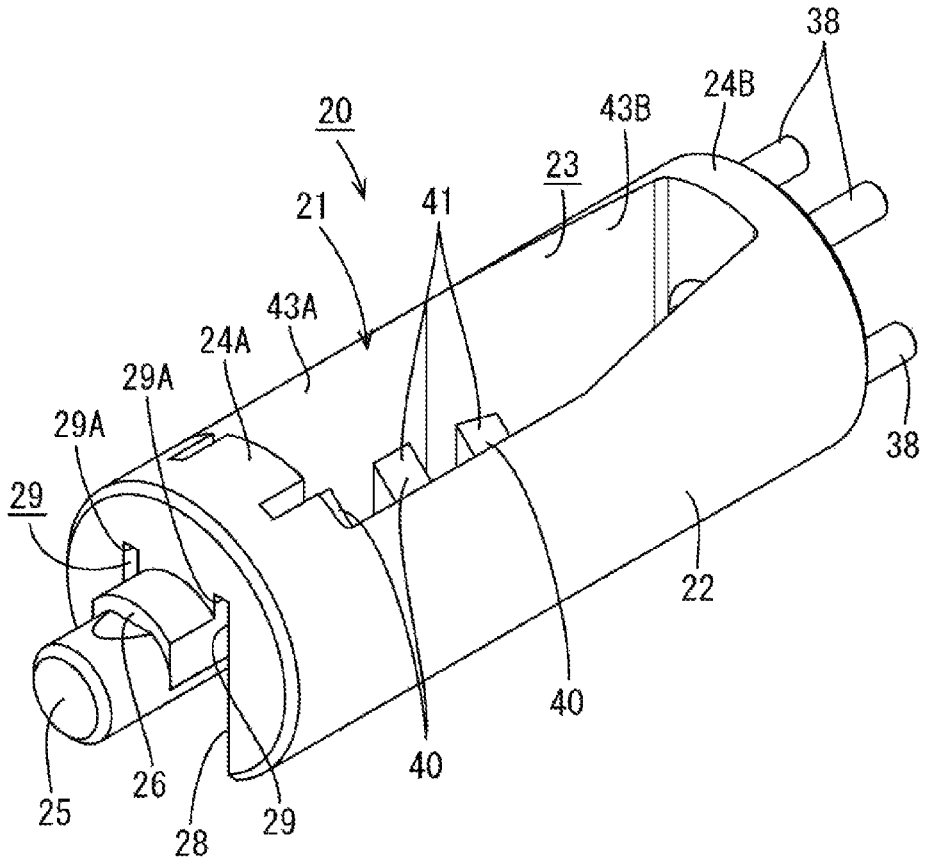
FIG. 4 is a perspective view of a sleeve.
Figure 8:
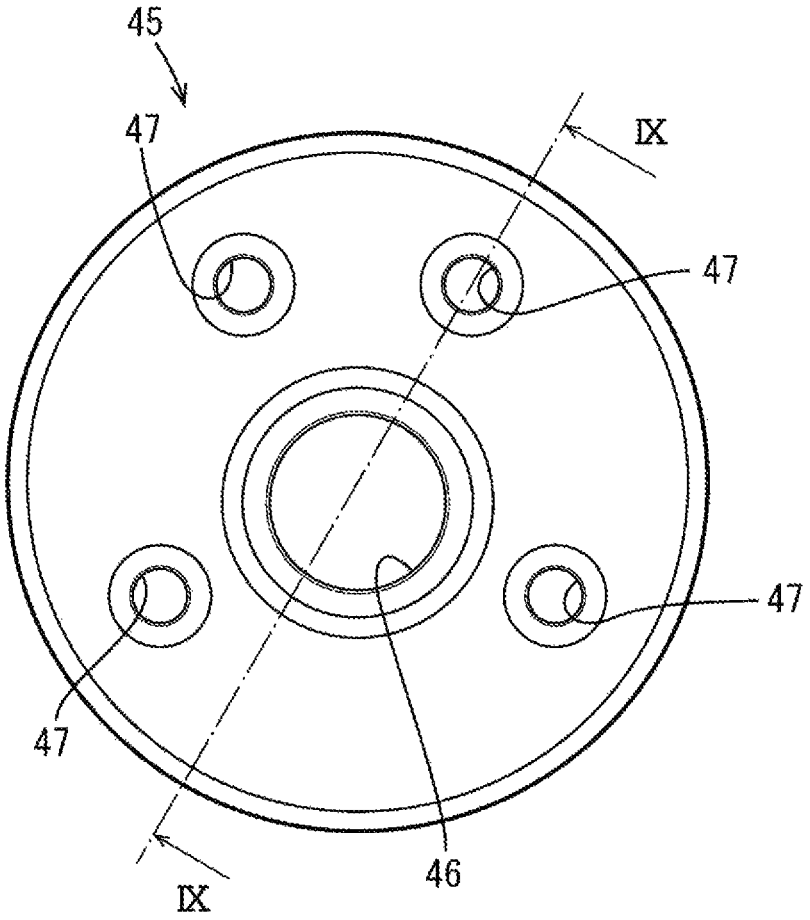
FIG. 8 is a front view of a rubber plug.
Figure 9:
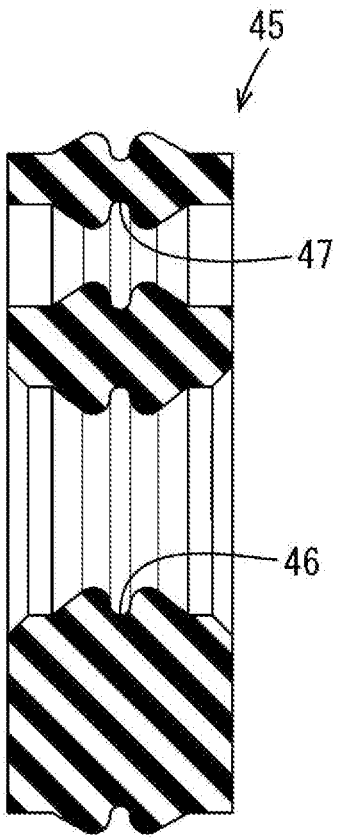
FIG. 9 is a section along IX-IX of FIG. 8.
Figure 10:
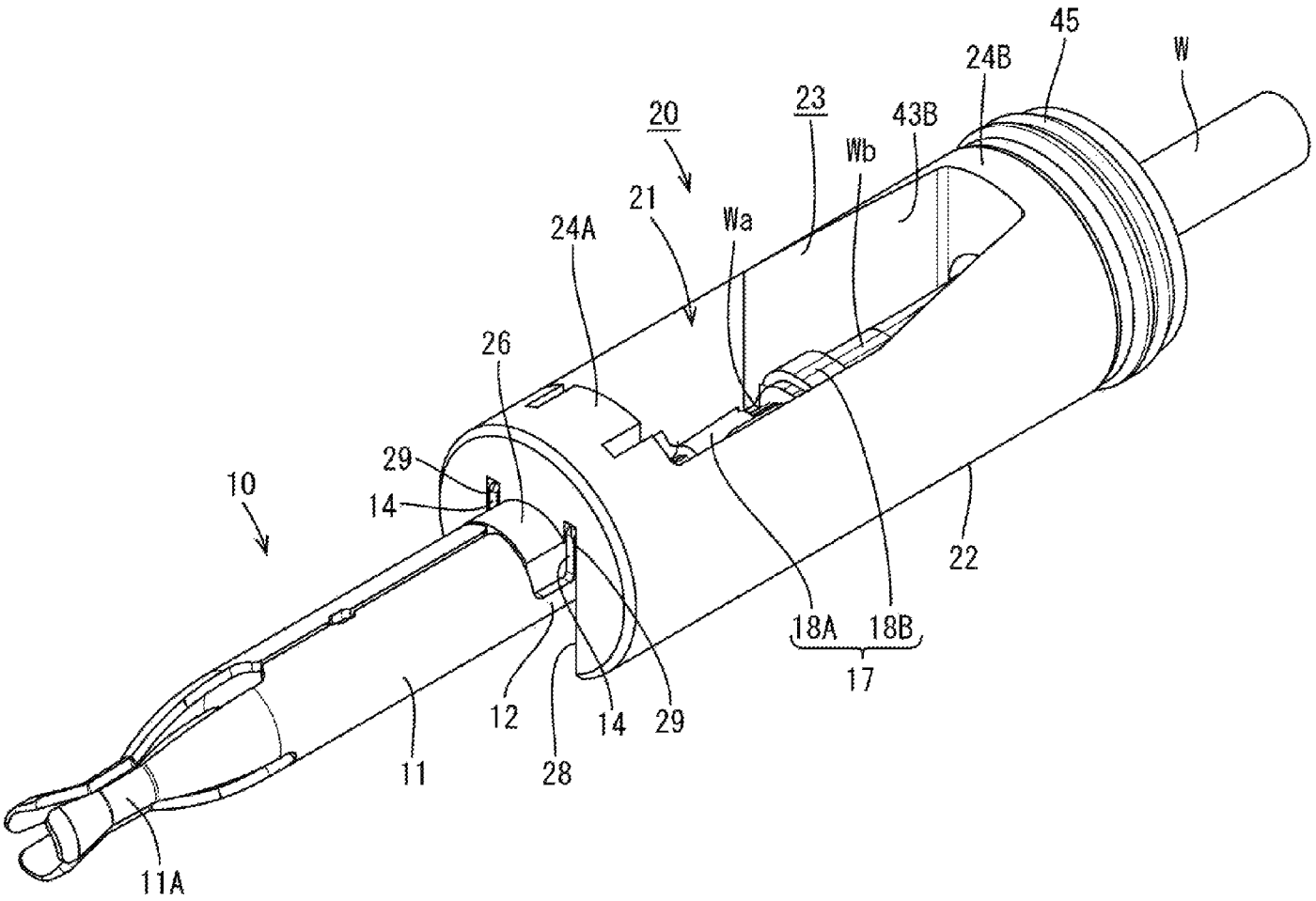
FIG. 10 is a perspective view of a state where the terminal fitting, the sleeve and the rubber plug are mounted on an end of a wire.
Figure 11:
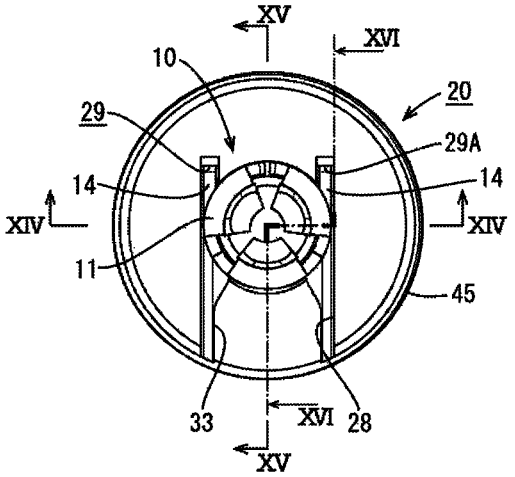
FIG. 11 is a front view of the state of FIG. 10.
Figure 12:
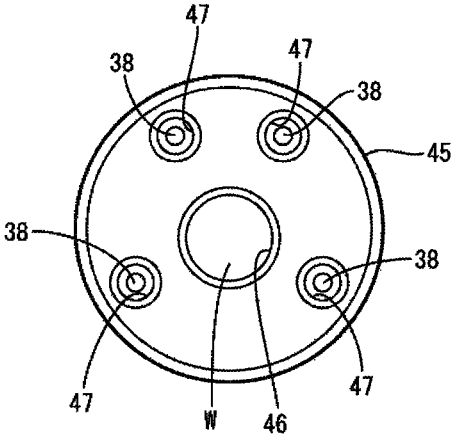
FIG. 12 is a rear view of the state of FIG. 10.
Figure 13:
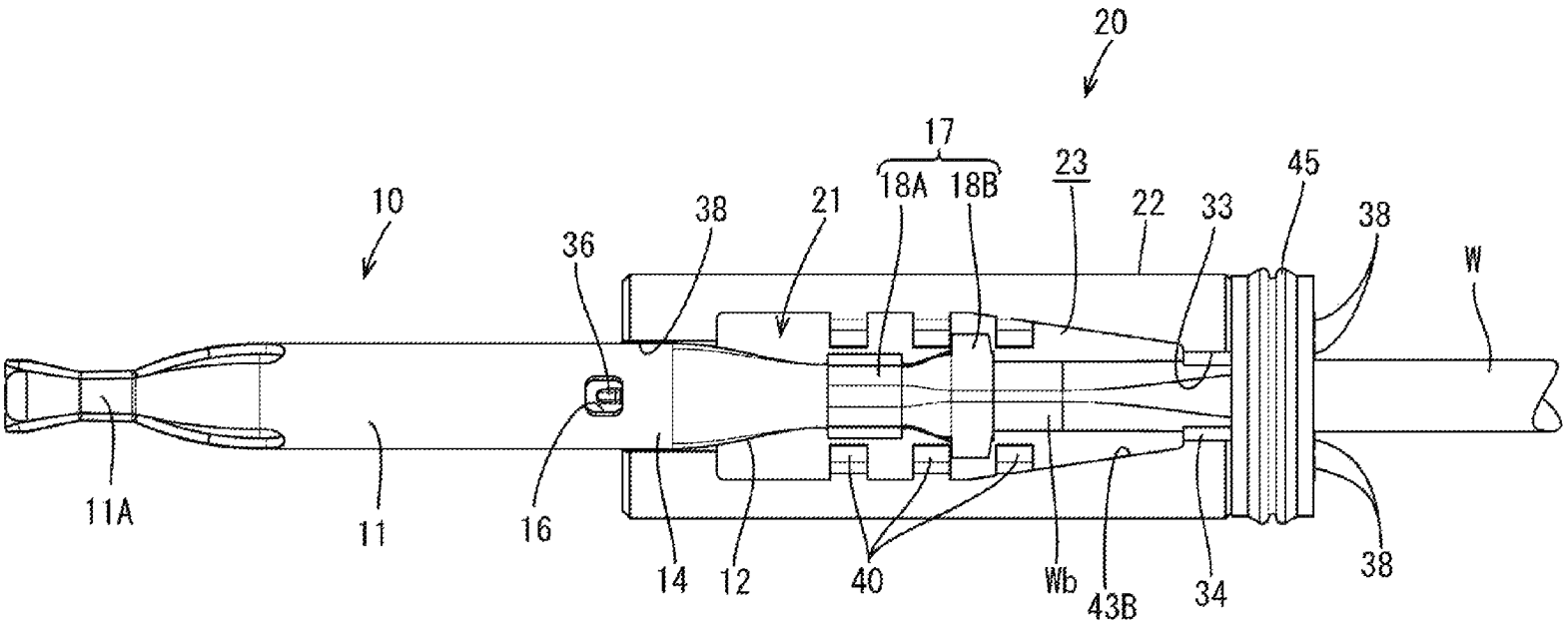
FIG. 13 is a plan view of the state of FIG. 10.

A rubber plug 45 is mounted on the rear end surface of the sleeve main body 22. As shown in FIGS. 8 and 9, the rubber plug 45 is formed into a thick ring shape closely fittable to the rear end part of the rear accommodating portion 58 of the terminal accommodating chamber 57, and the wire W is closely insertable into a center hole 46. As described above, the sleeve 20 functions to retain the terminal fitting 10 and, for that purpose, a plurality of (four in the shown example) rods 38 are formed to project backward in a predetermined arrangement on the rear surface of the sleeve main body 22 as shown in FIGS. 4 and 6. The rods 38 have a length slightly larger than a thickness of the rubber plug 45. On the other hand, the rubber plug 45 is formed with as many insertion holes 47 as the respective rods 38 in a corresponding arrangement, the rods 38 being tightly inserted into the insertion holes 47.

As shown in FIG. 18, a length of the sleeve 20 from the front surface of the sleeve main body 22 to projecting ends of the rods 38 is set to be equal to a length of the rear accommodating portion 58B.

A rear holder 60 (corresponding to wall surfaces of the terminal accommodating chambers 57) which functions such as to retain the sleeves 20 is mountable on the rear surface of the base portion 52 of the housing main body 51 as shown in FIG. 18. The rear holder 60 is made of synthetic resin and formed into a substantially cap shape in which a lock piece 64 projects forward from the peripheral edge of a circular holder base plate 61 formed with introducing grooves 62 for the wires W. The rear holder 60 is mounted to cover the rear end part of the base portion 52 of the housing main body 51. At this time, the projecting ends of the rods 38 projecting from the rear surface of the sleeve 20 and penetrating through the rubber plug 45 come into contact with the holder base plate 61 to be received, thereby preventing the sleeve 20 from coming out backward.

As partly already described, a part of the end of the wire W connected to the wire connecting portion 17 of the terminal fitting 10 by crimping is sealed, utilizing the heat shrinkable tube T. The heat shrinkable tube T is fitted on the outer periphery of the wire connecting portion 17 while being accommodated in the accommodation space 21 of the sleeve 20 arranged on the rear part of the terminal fitting 10 and, thereafter, held in close contact with the outer peripheries of the wire connecting portion 17 and the like by thermal shrinkage.

Figure 14:
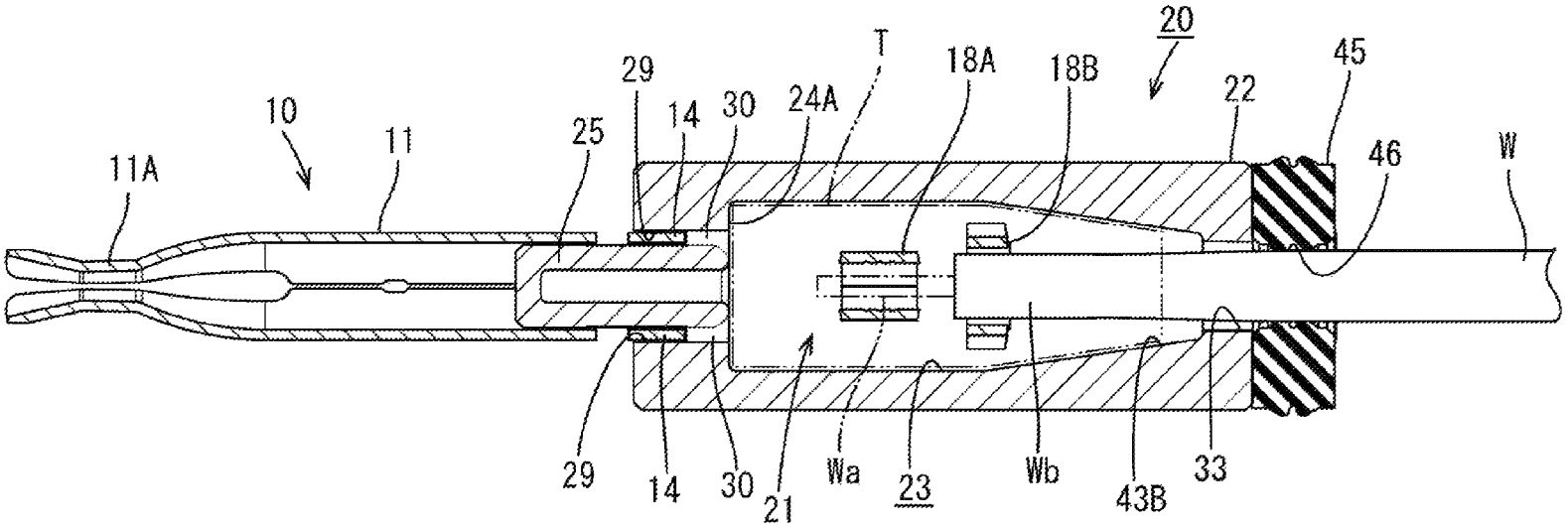
FIG. 14 is a section along XIV-XIV of FIG. 11.

The heat shrinkable tube T is made of synthetic resin having a lower melting point than the sleeve 20 and, as shown in FIGS. 14 and 15, has a diameter comparable to a width of the accommodation space 21 formed in the sleeve 20 and a length slightly shorter than the accommodation space 21 and is formed into a hollow cylindrical shape to have appropriate rigidity. Adhesive is applied to the inner peripheral surface of the heat shrinkable tube T.

A measure is taken to position and accommodate the heat shrinkable tube T shaped as described above in the accommodation space 21 of the sleeve 20.

First, ribs 40 for receiving parts of the lower surface of the heat shrinkable tube T near left and right end parts are formed to protrude on lower edge parts of left and right side surfaces of the accommodation space 21. Three ribs 40 are provided on each of left and right sides to face the corresponding ones on the opposite side, and formed at intervals in the front-back direction in a lengthwise central area of the lower edge part of each of the left and right side surfaces. A receiving surface 41, which is an upper surface, of each rib 40 is located slightly below the wire connecting portion 17 of the terminal fitting 10, particularly the bottom surface of the insulation barrel 18B, and formed into an arcuate surface in conformity with the outer shape of the heat shrinkable tube T. Further, the accommodation space 21 is tapered to gradually narrow a width (gradually reduce a distance between the left and right side surfaces) toward the back in a rear side area which is slightly smaller than half the entire length area. In other words, the accommodation space 21 is such that the front side is an equal-width portion 43A and the rear side is a tapered portion 43B gradually narrowed toward the back.

Out of the three ribs 40 on each of the left and right sides, two ribs 40 on the front side are formed side by side at positions near a rear part of the equal-width portion 43A and one rib 40 on the rear side is formed at a position of a front part of the tapered portion 43*b*.

Next, functions of this embodiment are described.

The connector C is assembled, for example, in the following procedure. First, the terminal fitting 10 is connected to the end of the wire W. Specifically, the rubber plug 45 is first mounted on the end of the wire W and allowed to escape backward. In this state, the end processing such as stripping is applied to the end of the wire W, the wire barrel 18A is caulked and crimped to the end of the core Wa exposed on the wire W and the insulation barrel 18B is caulked and crimped to the end of the insulation coating Wb.

Thereafter, the heat shrinkable tube T is fitted from front of the terminal fitting 10 and pushed to a position to surround the caulked wire connecting portion 17 (wire barrel 18A and insulation barrel 18B). At this time, the heat shrinkable tube T is received by the upper surface of the wire connecting portion 17 and the like in a hanging-down state.

Subsequently, the sleeve 20 is coupled and mounted on the rear part of the terminal fitting 10. The sleeve 20 is arranged above the wire connecting portion 17 of the terminal fitting 10 while assuming an oblique posture inclined downwardly toward the front and, after the tip of the fitting protrusion 25 is inserted into the opening on the rear surface of the terminal connecting portion 11 of the terminal fitting 10, the sleeve 20 is pushed forward while the rear end side is pushed down to change the orientation into a horizontal posture.

As the sleeve 20 is pushed down, the coupling portion 12 and the wire connecting portion 17 of the terminal fitting 10, the wire W pulled out from the wire connecting portion 17 and the fitted heat shrinkable tube T are radially inserted through the insertion groove 35 formed over the entire length of the lower surface. On the other hand, as the sleeve 20 is pushed forward, the fitting protrusion 25 is inserted into the rear end part of the terminal connecting portion 11 and the left and right inclination regulating pieces 14 of the terminal fitting 10 are inserted into the left and right slits 29 from front.

When the sleeve 20 is pushed down into the horizontal posture, the wire W pulled out from the wire connecting portion 17 is pushed until coming into contact with the ceiling surface of the rear insertion groove 33 and locked by the left and right locking protrusions 34 to be prevented from coming out downward. Simultaneously, the sandwiched portions 15B of the left and right inclination regulating pieces 14 are held in contact with the ceiling surfaces 29A of the slits 29.

The forward pushing of the sleeve 20 is stopped by the contact with the stopper portion 26 provided on the upper surface of the base end of the fitting protrusion 25 with the upper edge of the rear end surface of the terminal connecting portion 11. At this time, as shown in FIG. 16, the sandwiching protrusions 30 formed to protrude on the left and right side surfaces of the front insertion groove 28 come to the lower surface sides of the projecting end parts of the sandwiched portions 15B of the inclination regulating pieces 14, with the result that the sandwiched portions 15B of the left and right inclination regulating pieces 14 are sandwiched by the ceiling surfaces 29A of the slits 29 and the sandwiching protrusions 30, whereby the terminal fitting 10 and the sleeve 20 are concentrically coupled while being regulated not to incline such that the axial lines thereof are inclined relative to each other. In addition, the lock protrusion 36 of the fitting protrusion 25 of the sleeve 20 is fitted into the lock hole 16 of the coupling portion 12, and the terminal fitting 10 and the sleeve 20 are locked in a concentrically and integrally coupled state while the inclination thereof is regulated as described above.

During this time, particularly as the sleeve is pushed down into the horizontal posture, the heat shrinkable tube T is pushed up into the accommodation space 21 while being sandwiched and passing between the ribs 40 on the left and right sides. The rear end of the heat shrinkable tube T is pressed against the tapered portion 43B in the rear end part of the accommodation space 21 and moves forward until coming into contact with the front wall 24A by a resulting cam action. Along with that, the left and right end parts of the lower surface of the heat shrinkable tube T are received by the receiving surfaces 41 of the ribs 40 on the left and right sides when the heat shrinkable tube T completely passes over the ribs 40 on the left and right sides and, and the heat shrinkable tube T is held in a lifted-up state.

More specifically, the lower part of the inner peripheral surface of the heat shrinkable tube T approaches the bottom surface of the wire connecting portion 17, whereas the heat shrinkable tube T and the wire connecting portion 17 are held in such a fitted state that a sufficient clearance is secured between the upper part of the inner peripheral surface and the upper surface of the wire connecting portion 17.

In addition, the heat shrinkable tube T is pushed until coming into contact with the front wall 24A of the accommodation space 21 in the axial direction, thereby being fitted over the wire connecting portion 17 and predetermined areas before and after the wire connecting portion 17.

In a state where the sleeve 20 is assembled with the terminal fitting 10 as described above, the assembly is set in the unillustrated heating apparatus to perform a heating operation of heating the heat shrinkable tube T through the through hole 23 of the sleeve 20. Here, since the terminal fitting 10 and the sleeve 20 are integrally coupled not to incline relative to each other and locked, the assembly is easily handled such as when being set in the heating apparatus.

When being heated, the heat shrinkable tube T is gradually contracted in diameter while the adhesive applied to the inner peripheral surface is melted. Since the upper part of the inner peripheral surface of the heat shrinkable tube T is not placed on the wire connecting portion 17 to secure the clearance and a space on the lower side of the inner peripheral surface of the heat shrinkable tube T is eliminated, the flow-down of the adhesive on the upper side of the inner peripheral surface is suppressed. Particularly, it is significant to ensure the amount of the adhesive on the upper side of the inner peripheral surface of the heat shrinkable tube T held in close contact with the uneven upper surface of the wire connecting portion 17.

Thus, when the heat shrinkable tube T is contracted in diameter until coming into close contact with the outer peripheral surface of the wire connecting portion 17, the heat shrinkable tube T is bonded with the amount of the adhesive ensured over the entire circumference including the uneven upper surface, with the result that sealing is reliably provided around the wire connecting portion 17, i.e. the end of the wire W over the entire circumference.

Further, since the heat shrinkable tube T is positioned and fitted over the wire connecting portion 17 and the predetermined areas before and after the wire connecting portion 17, the heat shrinkable tube T is reliably held in close contact with the wire connecting portion 17 over the entire length including front and rear areas and sealability is ensured.

After a sealing operation by thermally shrinking the heat shrinkable tube T is completed, the rubber plug 45 is mounted on the rear surface of the sleeve main body 22. The rubber plug 45 allowed to escape is slid toward the end side along the wire W and pushed and mounted until coming into contact with the rear surface of the sleeve main body 22 while the respective rods 38 are inserted into the corresponding insertion holes 47. As a result, the terminal fitting 10, the sleeve 20 and the rubber plug 45 are mounted on the end of the wire W.

The terminal fitting 10, the sleeve 20 and the rubber plug 45 mounted on the end of the wire W as described above are inserted into the corresponding terminal accommodating chamber 57 formed in the housing main body 51 from behind. The insertion is stopped when the front surface of the sleeve main body 22 comes into contact with the front surface (stepped surface) of the rear accommodating portion 58B as shown in FIG. 18, the terminal connecting portion 11 of the terminal fitting 10 is inserted substantially over the entire length into the front accommodating portion 58A and the rubber plug 45 mounted on the rear surface of the sleeve main body 22 is tightly fitted into the rear end part of the rear accommodating portion 58B.

After the predetermined terminal fittings 10 are inserted into all the terminal accommodating chambers 57, the rear holder 60 is arranged behind the base portion 52 while the wires W pulled out from the rear surface of the base portion 52 of the housing main body 51 are inserted into the introducing grooves 62. When the rear holder 60 is slid forward along the wires W and fitted and locked to the rear surface of the base portion 52, the holder base plate 61 comes into contact with the tips of the rods 38 projecting from the rear surfaces of the sleeve main bodies 22 and penetrating through the rubber plugs 45 to retain the sleeves 20. In this way, the rear end of the terminal connecting portion 11 of the terminal fitting 10 comes into contact with the stopper portion 26 of the sleeve 20 retained by the rear holder 60 if a backward tensile force acts on the wire W, with the result that each terminal fitting 10 is retained and accommodated in the corresponding terminal accommodating chamber 57 (front accommodating portion 58A).

In the above manner, the assembling of the connector C is completed, the thus assembled connector C is mounted on the tip part of the gun-shaped case and the wires W pulled out backward from the connector C are pulled out from the rear end of the gun-shaped case and connected to an external power supply after being bundled.

During a charging operation, the connector C provided on the tip of the gun-shaped case is connected to the mating vehicle-side connector through the insertion port open on the panel of the vehicle.

Even if water enters the terminal accommodating chamber 57 from the front surface side of the housing 50, the entrance of water into the wire W is prevented since the wire connecting portion 17 of the terminal fitting 10, i.e. the end of the wire W is sealed around by the heat shrinkable tube T. Alternatively, if water is going to enter the housing 50 from the rear surface side after entering the gun-shaped case, water entrance from the back is prevented since the rubber plug 45 is mounted in the rear end part of the rear accommodating portion 58B, thereby reliably preventing water entrance into the wire connecting portion 17.

Further, when a force acts to swing the wire W pulled out backward from the housing 50, the terminal fitting 10 may be relatively largely inclined in the terminal accommodating chamber 57 if the terminal fitting 10 and the sleeve 20 are coupled to be inclinable relative to each other. In contrast, in this embodiment, the terminal fitting 10 and the sleeve 20 are coupled one after the other in such a manner as to regulate the relative inclination thereof as described above and formed as a so-called long object. Thus, even if a force acts to swing the wire W, the amount of inclination of the terminal fitting 10 constituting the long object, i.e. a part of the long object in the terminal accommodating chamber 57 (front accommodating portion 58A) is suppressed.

Thus, in connecting the terminal fitting 10 to the mating terminal by connecting the connector C to the vehicle-side connector, the both terminals are facing each other substantially on the same axial line and can be precisely and smoothly connected. Further, after the two connectors are connected and the terminal fittings are connected, the amount of inclination of the terminal fittings 10 is suppressed, whereby the application of excessive load to the contact portions 11A and the like is avoided.

According to this embodiment, the following effects can be obtained. In sealing the end of the wire W by the heat shrinkable tube T, the heat shrinkable tube T fitted on the wire connecting portion is heated in the accommodation space 21 of the sleeve 20. The heat shrinkable tube T is lifted up by the ribs 40 provided in the sleeve 20 and the lower part of the inner peripheral surface of the heat shrinkable tube T approaches the bottom surface of the wire connecting portion 17. The heat shrinkable tube T is held in such a fitted state that the sufficient clearance is secured between the upper part of the inner peripheral surface of the heat shrinkable tube T and the upper surface of the wire connecting portion 17. In addition, the heat shrinkable tube T is pushed forward in the axial direction by the tapered portion 43B, thereby being fitted over the wire connecting portion 17 and the predetermined areas before and after the wire connecting portion 17.

When heated in this state, the heat shrinkable tube T is gradually contracted in diameter while the adhesive applied to the inner peripheral surface is melted. However, since the upper part of the inner peripheral surface of the heat shrinkable tube T is not placed on the wire connecting portion 17 to secure the clearance, and the space on the lower side of the inner peripheral surface of the heat shrinkable tube T is eliminated, the flow-down of the adhesive on the upper side of the inner peripheral surface is suppressed. The amount of the adhesive on the upper side of the inner peripheral surface of the heat shrinkable tube T held in close contact with the uneven upper surface of the wire connecting portion 17 is ensured without decreasing.

Thus, when the heat shrinkable tube T is contracted in diameter until coming into close contact with the outer peripheral surface of the wire connecting portion 17, the heat shrinkable tube T is bonded with the amount of the adhesive ensured over the entire circumference including the uneven upper surface. As a result, sealing is reliably provided around the wire connecting portion 17, i.e. the end of the wire W over the entire circumference. Further, since being positioned and fitted over the wire connecting portion 17 and the predetermined areas before and after the wire connecting portion 17 in the axial direction, the heat shrinkable tube T is reliably held in close contact with the wire connecting portion 17 over the entire length including front and rear areas and sealability is ensured.

Further, since the heat shrinkable tube T is positioned in the radial and axial directions utilizing the sleeve 20, which is a component necessary to retain and accommodate the terminal fitting 10 in the terminal accommodating chamber 57 of the housing 50, the simplification of a sealing step and the like is realized, which can contribute to a cost reduction, as compared to the case where a positioning member is separately provided.

The sleeve 20 is structured such that the accommodation space 21 capable of accommodating the heat shrinkable tube T inside is provided and, on the other hand, the insertion groove 35, through which the wire connecting portion 17 and the predetermined areas before and after the wire connecting portion 17 in the terminal fitting 10 are radially insertable together with the heat shrinkable tube T, is formed over the entire length on the lower surface, the lift-up ribs 40 are formed along the groove edges of the insertion groove 35 and the tapered portion 43B is provided in the rear end part of the accommodation space 21.

Thus, the sleeve 20 is mounted on the rear part of the terminal fitting 10 while the wire connecting portion 17 (including the front and rear areas) and the heat shrinkable tube T are radially inserted through the insertion groove 35. At that time, the heat shrinkable tube T is lifted up by the ribs 40, held in such a fitted state that the clearance is secured between the heat shrinkable tube T and the upper surface of the wire connecting portion 17 and pushed forward up to the proper position by the tapered portion 43B. As a result, the heat shrinkable tube T can be positioned in the radial and axial directions while easy mounting of the sleeve 20 is ensured.

Further, when the sleeve 20 accommodating the heat shrinkable tube T is coupled on the rear part of the terminal fitting 10, the terminal fitting 10 and the sleeve 20 are temporarily assembled in the coupled state by a lock portion (lock protrusion 36 and lock hole 16). Thus, when being set in the heating apparatus, the coupled terminal fitting 10 and sleeve 20 are easily handled without being folded or separated and a heating operation of the heat shrinkable tube T and the like can be efficiently performed.

The technology disclosed by this specification is not limited to the above described and illustrated embodiment. For example, the following is also included in a technical scope.

Although the sleeve illustrated is shaped such that the insertion groove, through which the wire connecting portion of the terminal fitting is radially insertable, is formed on the outer peripheral surface in the above embodiment, the sleeve may be shaped to be fitted around the wire connecting portion along the axial direction without including such an insertion groove.

Although the three ribs arranged side by side on each of the left and right sides are illustrated as lift-up portions in the above embodiment, the number and shape of the lift-up portions are arbitrary as long as the lift-up portions can lift up the heat shrinkable tube before thermal shrinkage in the radial direction against the own weight of the heat shrinkable tube.

An axial positioning portion for the heat shrinkable tube is not limited to the tapered portion illustrated in the above embodiment and another structure such as simple contact with the rear end of the heat shrinkable tube may be applied.

It is not always necessary to provide the axial positioning portion for the heat shrinkable tube and such a mode is also inclined in the technical scope.

Although an inclination regulating portion for regulating such inclination of the terminal fitting and the sleeve that the axial lines thereof are inclined relative to each other and the lock portion for locking the terminal fitting and the sleeve in the coupled state are provided in the part where the terminal fitting and the sleeve are coupled in the above embodiment, either one or both of the inclination regulating portion and the lock portion may be omitted and such a mode is also inclined in the technical scope.

Although an open barrel is illustrated as the wire connecting portion of the terminal fitting in the above embodiment, another structure such as a closed barrel may be adopted.

Although the charging connector is illustrated to have five poles in the above embodiment, the number of poles does not matter.

Further, the present invention can be widely applied to such connectors in general including a sleeve for retaining a terminal fitting and configured to seal an end of a wire by a heat shrinkable tube.

LIST OF REFERENCE SIGNS

C . . . charging connector (connector)
T . . . heat shrinkable tube
W . . . wire
10 . . . terminal fitting
11 . . . terminal connecting portion
16 . . . lock hole (lock portion)
17 . . . wire connecting portion
20 . . . sleeve
21 . . . accommodation space
23 . . . through hole
26 . . . stopper portion
35 . . . insertion groove
38 . . . rod
40 . . . rib (lift-up portion)
43B . . . tapered portion (positioning portion)
46 . . . lock protrusion (lock portion)
50 . . . housing
57 . . . terminal accommodating chamber
60 . . . holder (wall surfaces of terminal accommodating chambers 57)

What is claimed is:

1. A connector, comprising:

a terminal fitting including a wire connecting portion to be crimped to an end of a wire and configured to be inserted into a terminal accommodating chamber formed in a housing from behind;

a sleeve to be mounted on a rear part of the terminal fitting and functioning to retain the terminal fitting by being engaged with each of the terminal fitting and a wall surface of the terminal accommodating chamber; and a heat shrinkable tube to be fitted on an outer periphery of the wire connecting portion of the terminal fitting while being accommodated in the sleeve and to be held in close contact with the outer periphery by being thermally shrunk, wherein the sleeve including a lift-up portion for holding the heat shrinkable tube in such a fitted state that a clearance is secured between the heat shrinkable tube and an upper surface of the wire connecting portion by lifting up the heat shrinkable tube before thermal shrinkage in a radial direction against the own weight of the heat shrinkable tube.

2. The connector of claim 1, wherein the sleeve includes a positioning portion configured to regulate a backward movement of the heat shrinkable tube by being engaged with a rear end of the heat shrinkable tube before thermal shrinkage.

3. The connector of claim 2, wherein an insertion groove enabling the wire connecting portion to be radially inserted and accommodated therethrough is formed on an outer peripheral surface of the sleeve and the positioning portion is configured by forming a tapered portion gradually narrowed toward back on a wall surface of a rear end part of an accommodation space of the sleeve.

4. The connector of claim 1, wherein an insertion groove enabling the wire connecting portion to be radially inserted and accommodated therethrough is formed on an outer peripheral surface of the sleeve and the lift-up portion is configured by ribs formed along a groove edge of the insertion groove.

5. The connector of claim 4, wherein a lock portion configured to hold the terminal fitting and the sleeve in a coupled state is provided between the terminal fitting and the sleeve.

* * * * *